US006570316B1

(12) United States Patent
Hergott

(10) Patent No.: US 6,570,316 B1
(45) Date of Patent: May 27, 2003

(54) TELEVISION TUBE HAVING SUBSTANTIALLY LINEAR EDGES

(75) Inventor: Stefan Hergott, Wiesbaden (DE)

(73) Assignee: Schott Glas, Mainz (DE)

( * ) Notice: Subject to any disclaimer, the term of this patent is extended or adjusted under 35 U.S.C. 154(b) by 80 days.

(21) Appl. No.: 09/641,800

(22) Filed: Aug. 18, 2000

(30) Foreign Application Priority Data

Aug. 21, 1999 (DE) ..... 199 39 794

(51) Int. Cl.[7] ..... H01J 29/10
(52) U.S. Cl. ..... 313/461; 313/477 R
(58) Field of Search ..... 313/461, 477 R

(56) References Cited

U.S. PATENT DOCUMENTS 4,121,257 A 10/1978 Krishnamurthy

FOREIGN PATENT DOCUMENTS

| | | |
|---|---|---|
| CA | 2039822 | 11/1991 |
| DE | 2808564 C2 | 8/1978 |
| DE | 4114606 A1 | 11/1991 |
| EP | 0917175 A1 | 5/1999 |
| JP | 11135038 A | 5/1999 |

*Primary Examiner*—Vip Patel
(74) *Attorney, Agent, or Firm*—Baker & Daniels

(57) ABSTRACT

The invention relates to a television tube having a screen and a flare.

In accordance with the invention at least the front surface of the screen has the shape of a geometric rectangle or at least approximately said shape. The flare has a corresponding contour in the area where they are joined.

15 Claims, 1 Drawing Sheet

TELEVISION TUBE HAVING SUBSTANTIALLY LINEAR EDGES

BACKGROUND OF THE INVENTION

1. Field of the Invention

The invention relates to a television tube having a screen and a flare. The front surface of the screen facing the viewer is substantially rectangular.

Such television tubes work in accordance with the cathode ray principle. The above mentioned glass components, the screen and the flare, encompass an evacuated space. The television tube further comprises components for generating the image, particularly an electron beam canon, an electron beam deflector, a screening picture and a mask.

2. Description of the Prior Art

The border around the image area, i.e. the above mentioned front surface of the screen, is only approximately rectangular, occasionally it is approximately square as the side edges have an outward convex curve. Thus, the approximately rectangular screen has three radii: A small radius in any of the four corners, a considerably larger radius on the two narrow edges and an even larger radius on the two longitudinal edges. The contour of the screen is also maintained at its side flanks and continues on the flare. This applies to all styles, sizes and formats and to all previously known designs of the contour of the image area.

The divergence in the contour of the front surface of the screen depends on the required strength. In view of the negative pressure prevailing in the interior of the television tube the walls of the glass components have to be dimensioned accordingly so as to withstand said negative pressure. If this is not the case there is a risk of implosion which represents significant risks for the user. It is known that the resistance of hollow bodies to inside or outside forces is highest in spherical forms.

Therefore, the above mentioned divergence in the contour of the front surface of the screen from a pure rectangle, and thus also the design of the edges of the television tube, is selected so as to achieve the required strength at a given minimal wall thickness on the glass components. It is understood that the goal is to have the thinnest possible wall thickness so as to keep the weight of the television tube and its outside dimensions as low as possible.

SUMMARY

The object of the invention is to design a television tube of the above mentioned type such that its weight and its outside dimensions can be further reduced.

The problem is solved by means of the characteristic features of the independent claims. The inventor recognized that the change from the approximately rectangular shape to a pure rectangular shape does not at all decrease the vacuum resistance of the television tube. Instead the vacuum resistance is the same as before or even higher. The edges of the front surface of the screen do not have to be strictly linear for this purpose, and accordingly, the front surface does not have to be strictly rectangular or square. The same applies to the flank surfaces of the screen and the flare as seen in cross-section vertical to the axis of the image. Whatever applies to the design of the screen also applies to the design of the flare. Therefore, according to the invention the contour of the area where the flare joins is also designed such that at least one of its four edges is at least approximately linear.

As a result of the design of the invention the weight of the screen can be reduced by up to 5%. The same applies to the weight of the flare. The overall dimensions of the television tube also decrease. The housing encompassing the television tube can be smaller because of the levelness of the flank surfaces.

The coating on the interior surface of the screen is not impaired by the design according to the invention. It can also be rectangular while the quality of the transmitted image content remains the same.

The invention partially solves the above problem already if only one of the edges of the front surface of the screen is linear or largely linear. A higher effect is achieved if two opposing edges are linear or approximately linear. An optimal effect is achieved, however, when the invention is applied to all four edges.

With regard to the degree of linearity of the individual edges, the following can be said:

The divergence from a convex curve should be considerable. This means that the radius of curvature, if there is one, is at least double that of a conventional screen. Generally, it will be such that the course of any individual edge will be perceived as linear by the naked eye. The values in practice are as follows:

| Screen diagonal (cm) | Radius of curvature of the large edges (mm) | Radius of curvature of the small edges (mm) |
|---|---|---|
| 35 | 3000 | 1400 |
| 66 | 9000 | 5800 |
| 68 | 10000 | 7600 |
| 76 | 12000 | 6600 |
| 80 | 9800 | 9400 |
| 86 | 15400 | 8600 |
| 90 | 11000 | 10800 |

BRIEF DESCRIPTION OF THE DRAWINGS

The invention is described in more detail by means of a drawing showing the following.

DETAILED DESCRIPTION OF THE INVENTION

Figure 1:
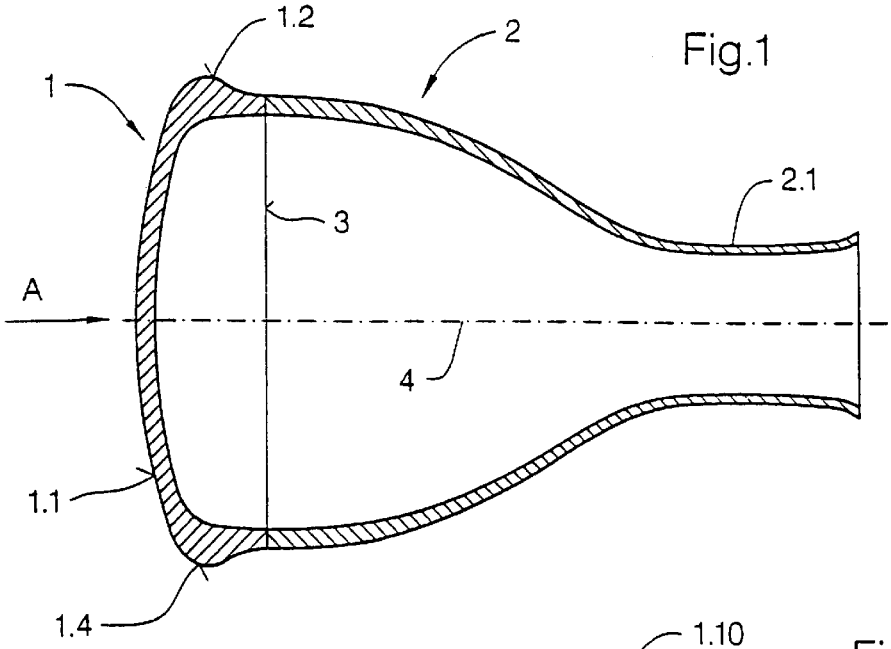
FIG. 1 shows a television tube in a side view, in profile through the axis of the image.

The television tube shown in FIG. 1 has a screen 1 and a flare 2. The electronic and electrical details will not be discussed in more detail.

The two above mentioned components, the screen 1 and the flare 2, are joined along a plane 3 running vertical to the axis 4 of the television tube.

The screen 1 has a front surface 1.1 and flank surfaces, of which only the two opposing flanks 1.2, 1.4 are shown.

Figure 2:
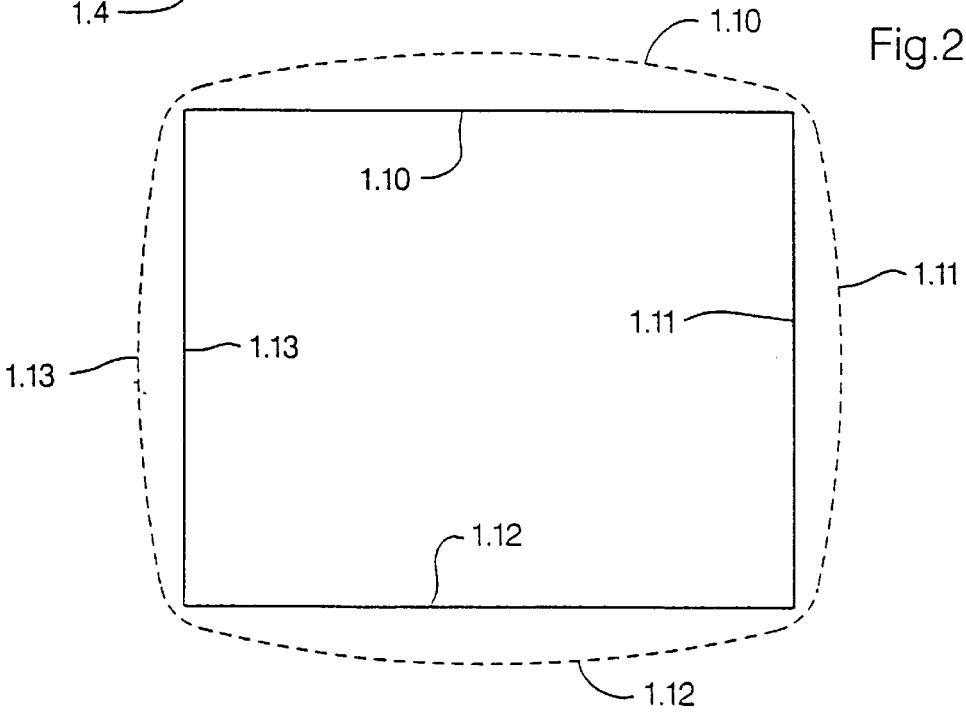
FIG. 2 shows the subject of FIG. 1 with a top view of the front surface of the screen.

FIG. 2 shows the front surface of a television tube according to the invention. It is evident that the front surface is designed as a geometric rectangle formed by the edges 1.10, 1.11, 1.12 and 1.13. A radius of curvature may be present in the four corners, but this is not mandatory.

The shape of a pure rectangle according to the invention is encompassed by the shape of an approximate rectangle as is the case in a conventional television tube, shown as a dotted line. The four edges 1.10', 1.11', 1.12' and 1.13' are shown. The course of these edges is approximately in accordance with the arc of a circle.

According to the invention not only the front surface of the screen 1 has the above shape. This contour may also continue in the direction of the neck 2.1 of the flare 2. Accordingly, the screen may also have the shape of the invention, in a vertical profile with regard to the axis 4 in the area of the flank surfaces.

The shape of the invention can then continue beyond the separating plane 3 in the direction toward the neck 2.1 of the flare 2 so that the flare, again as seen in profile vertical with regard to the axis 4 of the image, also has the shape of the invention, at least over a portion of its longitudinal expansion.

Figure 3:
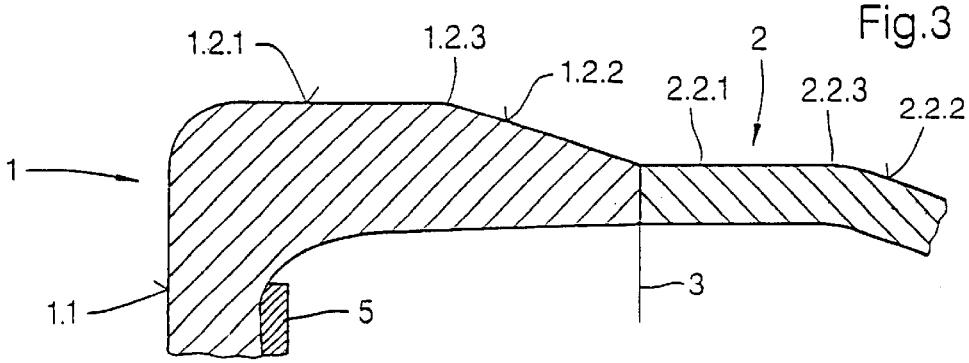
FIG. 3 shows a section of the subject of FIG. 1 in the area of the connecting plane between the screen and the flare, as an enlargement.

In FIG. 3, the outside contour of the screen 1 and the outside contour of the flare 2 in the area of the separating plane 3 are even more clearly evident. It shows that the front surface 1.1 of the screen 1 is completely level. The flank surface 1.2 consists of a partial surface 1.2.1 and a partial surface 1.2.2. Each surface is on a plane. 1.2.3 designates a bend.

The course of the outside contour of the flare 2 in the area of the separating plane 3 is very similar. Again, two partial surfaces 2.2.1 and 2.2.2 are shown. Each of these is on a plane. 2.2.3 designates a bend.

In one form of the invention, at least one edge 1.10, 1.11, 1.12, or 1.13 is curved convex and has a radius of curvature that is at least 50 times the diagonal of screen 1.

The interior surface of the screen is provided with a coating 5 which has no direct relevance for the invention.

What is claimed is:

1. A screen for a television tube for joining to a flare, said screen comprising:

a front surface of said screen facing a viewer being formed by four edges in the manner of a rectangle;

at least one of said four edges is at least approximately linear; and at least one of said edges is curved convex and has a radius of curvature that is at least 50 times a diagonal dimension of said screen.

2. The screen of claim 1 wherein at least one of said edges is curved convex and has a radius of curvature that is at least 100 times the diagonal dimension of said screen.

3. A flare for joining to the screen of a television tube, said flare comprising:

an area of joining where said flare joins to the screen, said area having a contour, said contour of said area as seen from the top being formed by four edges in the manner of a rectangle;

at least one of said four edges is at least approximately linear; and at least one of said edges is curved convex and has a radius of curvature that is at least 50 times a diagonal dimension of the screen.

4. The flare of claim 3, wherein at least one of said four edges is curved convex and has a radius of curvature that is at least 100 times the diagonal dimension of said flare in said area of joining.

5. A television tube comprising:

a screen having a front surface facing a viewer; and a flare being joined to said screen, an area being defined where said flare joins said screen, said area having a contour;

wherein one of said front surface and said contour of said area as seen from top is formed by four edges in the manner of a rectangle;

wherein at least one of said edges is approximately linear and at least one of said edges is curved convex and has a radius of curvature that is at least 50 times a diagonal dimension of one of said front surface and said contour of said area.

6. The television tube of claim 5 wherein said screen further comprises flank surfaces, a section of at least one of said flank surfaces joining said front surface in the direction of said flare is a level surface.

7. The television tube of claim 6, wherein the said level surface as viewed from the side is substantially parallel with a horizontal axis of an image.

8. The television tube of claim 7 wherein said level surface is joined in the direction of said flare by a second level surface which as viewed from the side converges with the axis of the image in the direction of the neck of said flare opposite said level surface.

9. The television tube of claim 8 wherein said second level surface of said screen as viewed from the side is joined by a first and a second level surface of said flare, and that the contours of said screen and said flare as viewed from the side are similar in geometry.

10. The television tube of claim 9 wherein said front surface of said screen is on a plane.

11. The television tube of claim 5 wherein said front surface of said screen is on a plane.

12. The television tube of claim 6 wherein said front surface of said screen is on a plane.

13. The television tube of claim 7 wherein said front surface of said screen is on a plane.

14. The television tube of claim 8 wherein said front surface of said screen is on a plane.

15. The television tube of claim 5, wherein at least one of said edges is curved convex and has a radius of curvature that is at least 100 times a diagonal dimension of one of said front surface and said contour of said area.

* * * * *